US007883357B2

(12) United States Patent
Lin et al.

(10) Patent No.: US 7,883,357 B2
(45) Date of Patent: Feb. 8, 2011

(54) ELECTRICAL CONNECTOR ASSEMBLY WITH HEAT DISSIPATING DEVICE

(75) Inventors: Nan-Hung Lin, Tu-Cheng (TW); Chih-Pi Cheng, Tu-Cheng (TW); Shuo-Hsiu Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/481,605

(22) Filed: Jun. 10, 2009

(65) Prior Publication Data

US 2009/0305524 A1 Dec. 10, 2009

(30) Foreign Application Priority Data

Jun. 10, 2008 (TW) ..... 97210234 U

(51) Int. Cl.
*H01R 13/00* (2006.01)

(52) U.S. Cl. ..... 439/487; 361/700; 361/719; 165/104.33; 257/718; 257/719

(58) Field of Classification Search ..... 439/487, 439/485; 361/700, 719, 720; 165/104.33; 257/718, 719
See application file for complete search history.

(56) References Cited

U.S. PATENT DOCUMENTS 6,625,021 B1 * 9/2003 Lofland et al. ..... 361/697
7,388,747 B2 * 6/2008 Yang et al. ..... 361/700
7,545,638 B2 * 6/2009 Aoto et al. ..... 439/487
7,619,895 B1 * 11/2009 Wertz et al. ..... 361/719
7,632,128 B2 * 12/2009 Lin et al. ..... 439/331
7,641,505 B2 * 1/2010 Ma ..... 439/485
7,701,721 B2 * 4/2010 Lin ..... 361/719
7,708,584 B2 * 5/2010 Hierholzer et al. ..... 439/487
2007/0236885 A1 * 10/2007 Zhao et al. ..... 361/700
2007/0236887 A1 * 10/2007 Cheng et al. ..... 361/700
2008/0291638 A1 11/2008 Ma et al.

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

An electrical connector assembly for electrically connecting an electrical package to a printed circular board, includes an electrical connector mounted on a printed circular board, and a heat dissipating device located upon the electrical package. The heat dissipating device includes a supporting body located upon the electrical connector, two latching pieces retaining the supporting body and heat pipes assembled on the supporting body. The latching piece rivets with the supporting body on a center part thereof, so when one end of the latching pieces is pressed downwardly, the opposite end will not be influenced.

19 Claims, 4 Drawing Sheets

ELECTRICAL CONNECTOR ASSEMBLY WITH HEAT DISSIPATING DEVICE

BACKGROUND OF THE INVENTION

1. Field of the invention

The present invention relates to an electrical connector assembly, and more particularly to an electrical connector assembly with a heat dissipating device to efficiently dissipate heat generated from a package mounted within the electrical connector assembly.

2. Description of the prior art

An electrical connector is widely used in electrically connecting a package and a printed circular board. A heat dissipating device is needed to be put on the package seated in the electrical connector, otherwise the electrical connector will not normally work and may destroy the package. Example for this kind of the electrical connector assembly is disclosed in U.S. patent application Ser. No. 2008-0291638, the electrical connector assembly comprises an electrical connector, an electrical package received in the electrical connector, a dissipating device mounted upon the electrical package and a latching pieces retaining the dissipating device. The dissipating device comprises a base and two heat pipes fixed to a bottom side of the base. The latching pieces has a main body pressing the dissipating device against the electrical package and four latching feet bent downwardly from four corners the latching pieces and located outside of the electrical connector. Each latching feet has a hole, a bolt passes through the hole to fix the latching pieces on the printed circular board. However, when one bolt firstly mount one latching feet to the printed circular board, the other three latching feet will rise upwardly, so the four bolts must be assembled at one time with adjusted directions to prevent the latching pieces from rising upwardly, that will result the electrical connector assembly needs a long time to assemble. Furthermore, if the latching pieces is not properly assembled, the electrical package will be pressed by an unbalanced force and may be destroyed.

Therefore, there is a need to supply an improved electrical connector assembly with a heat dissipating device.

SUMMARY OF THE INVENTION

An object of the present invention is to provide an electrical connector assembly with a heat dissipate device which can improve an assembly efficiency.

In order to achieve the object set forth, an electrical connector assembly comprises: a printed circular board; an electrical connector mounted on the printed circular board; and a heat dissipating device mounted upon the electrical connector and comprising a supporting body fixed with heat pipes and at least one latching piece pressing downwardly the supporting body, the latching pieces defining a hole on each end thereof for a bolt passing through to fix the latching piece on the printed circular board. The latching piece has a fixing portion abutting against the supporting body and riveting with the supporting body.

DESCRIPTION OF PREFERRED EMBODIMENT

Reference will now be made to the drawings to describe the present invention in detail.

Figure 1:
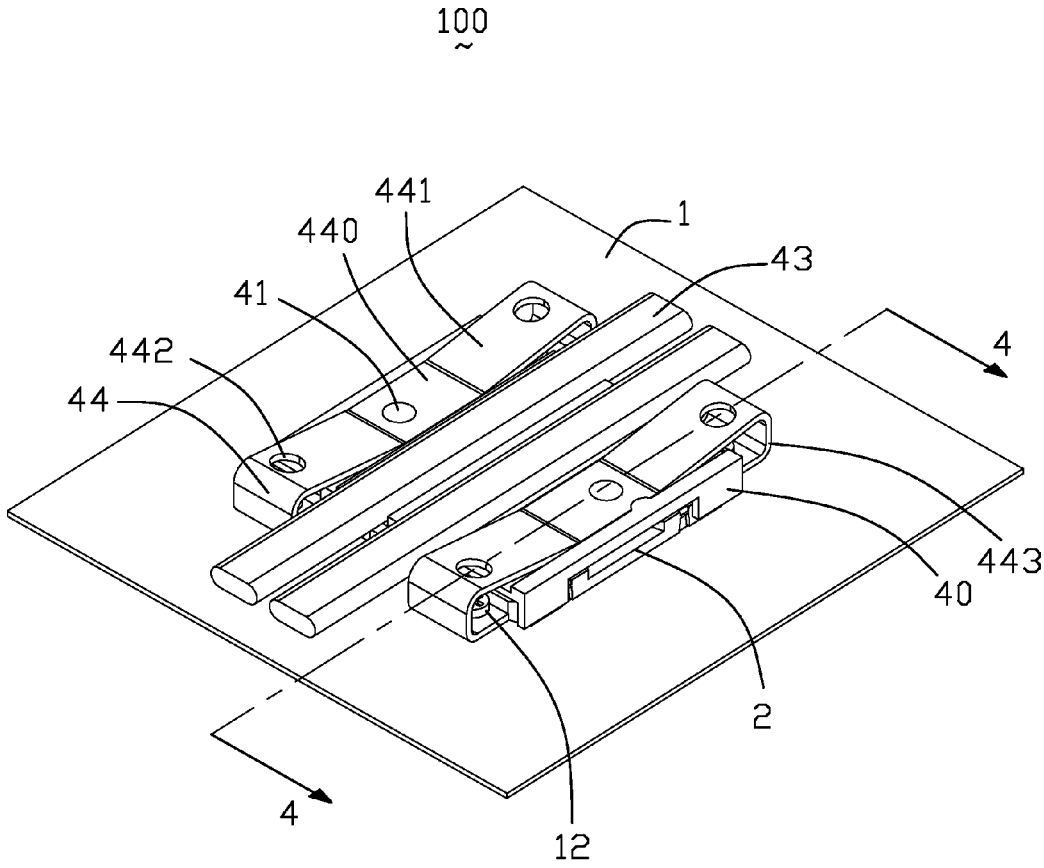
FIG. 1 is an assembled, perspective view of an electrical connector assembly in a preferred embodiment according to the present invention.
Figure 2:
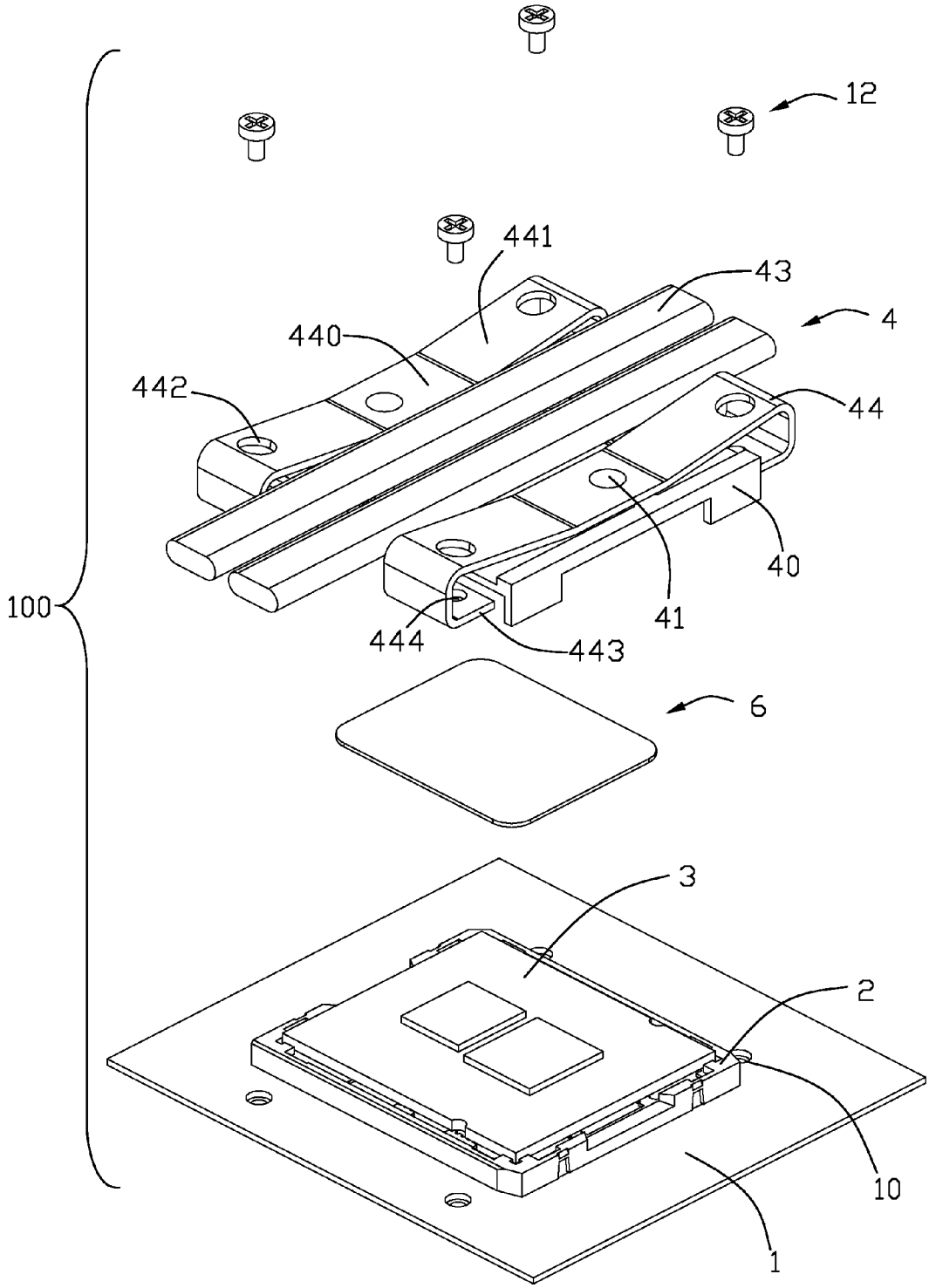
FIG. 2 is a partially exploded, perspective view of the electrical connector assembly shown in FIG. 1.
Figure 3:
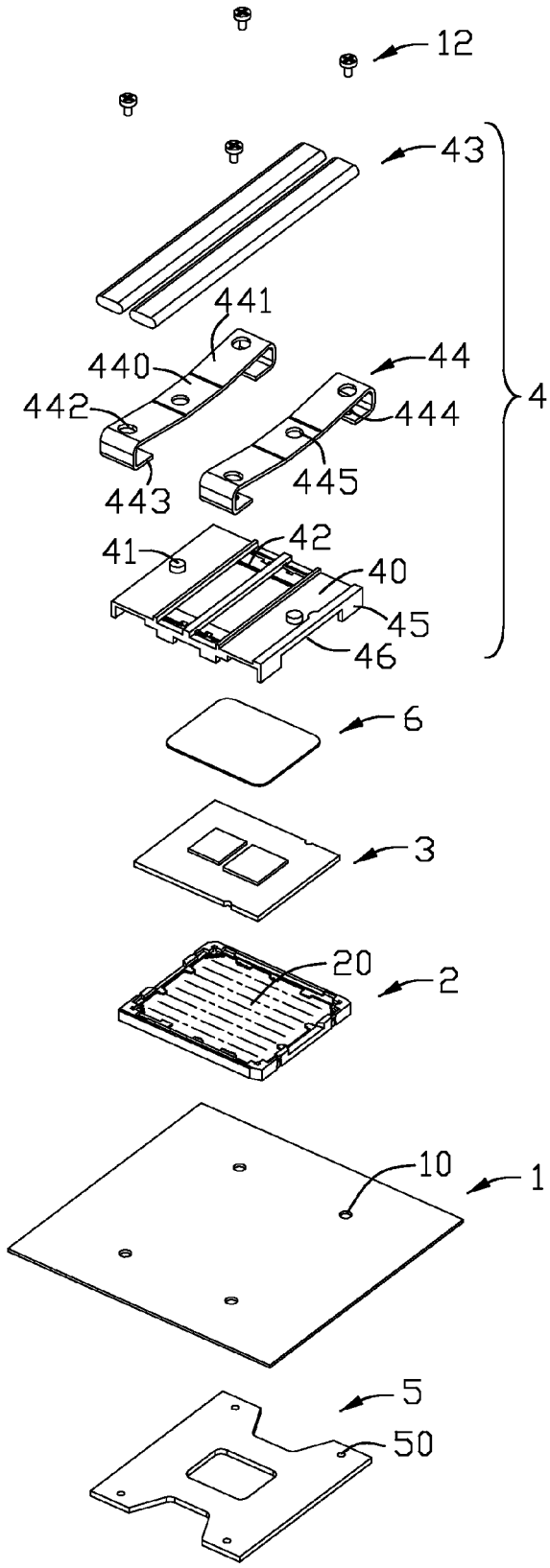
FIG. 3 is an exploded, perspective view of the electrical connector assembly shown in FIG. 2.
Figure 4:
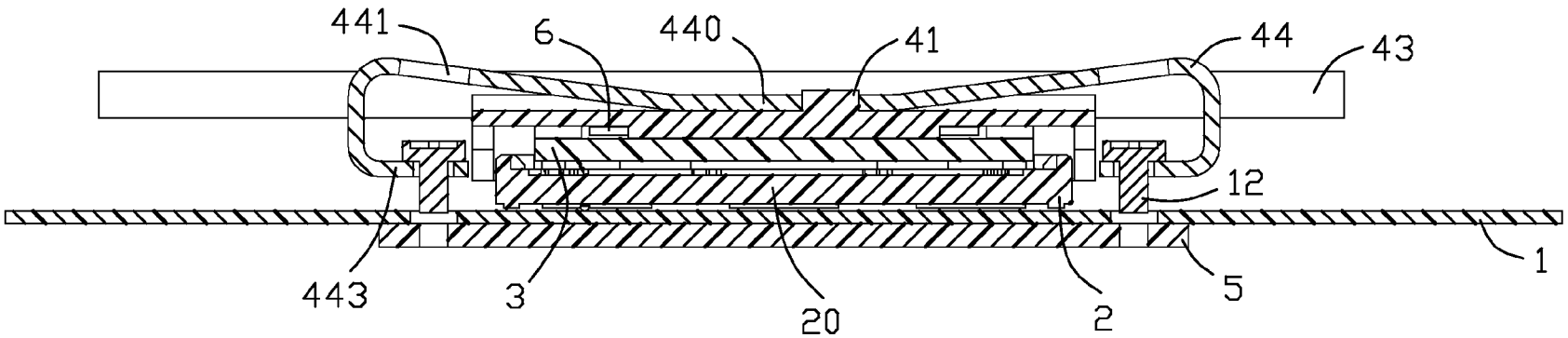
FIG. 4 is a section view of the electrical connector assembly in FIG. 1.

Referring to FIGS. 1-3, an electrical connector assembly 100 of present invention comprises a printed circular board 1, a backplane 5 located under the printed circular board 1, an electrical connector 2 mounted on the printed circular board 1, an electrical package 3 received in the electrical connector 2, a heat dissipating piece 6 mounted upon the electrical package 3 and a heat dissipating device 4 disposed upon the heat dissipating piece 6.

The printed circular board 1 defines four through holes 10. The backplane 5 is mounted under a bottom face of the printed circular board 1, and the backplane 5 has four mounting holes 50 corresponding to the through holes 10 of the printed circular board 1. Bolts 12 can assemble the heat dissipating device 4, the printed circular board 1 and backplane 5 together.

The electrical connector 2 comprises an insulative housing 20 and a plurality of contacts (not shown) received in the insulative housing 20 for electrically connecting the electrical package 3 and the printed circular board 1.

Referring to FIGS. 2-3, the heat dissipating piece 6 is mounted upon the electrical package 3, to transmit heat of the electrical package 3 produced in working to a corresponding part of the heat dissipating device 4. The heat dissipating device 4 presses a top surface of the heat dissipating piece 6, and comprises a supporting body 40 with an approximate quadrate shape, two latching pieces 44 disposed upon the supporting body 40 to retain the heat dissipating piece 6 to the printed circular board 1, two heat pipes 43 soldered on the supporting body 40. The supporting body 40 has four supporting potions 45 provided on a front end and a back end of each of two opposite sides thereof, respectively, and extending downwardly to set on the printed circular board 1. A receiving slot 46 is defined between two adjacent supporting portions 45 for receiving a corresponding part of the electrical connector 2. The supporting body 40 has a top surface with two opposite sides, a post 41 is formed on a middle part of each of the two opposite sides, the supporting body 40 defines two through slots 42 between the two opposite sides for receiving and retaining the heat dissipating pipes 43. The latching piece 44 has a fixing portion 440 and two spring portions 441 extending upwardly from two opposite ends of the fixing portion 440. The fixing portion 440 has a hole 445 in a center part thereof for receiving and riveting with the post 41, a connecting portion 443 is bent downwardly and inwardly from a free end of the spring portion 441. The spring portion 441 has a first circular hole 442 and a second circular hole 444 defined on the connecting portion 443, the first circular hole 442 has a diameter bigger than that of the second circular hole 444 and is located above the second circular hole 444, the bolts 12 can pass through the first and the second circular holes 442, 444.

When assembly, firstly solder the heat dissipating pipes 43 within the through slots 42 of the supporting body 40; then assemble the supporting body 40 with the latching pieces 44 by riveting the posts 41 of the supporting body 40 with the holes 445 of the fixing portions 440 of the latching pieces 44; after that, mount the electrical connector 2 on the printed circular board 1, put the electrical package 3 in the insulative housing 20, then mount the heat dissipating piece 6 upon the electrical package 3, put the assembled heat dissipating device 4 upon the dissipating piece 6; in the end, the bolts 12 pass through the first circular holes 442 and the second circular holes 444 of the latching pieces 44 and the through holes 10 of the printed circular board 1 and mounting holes 50 of the backplane 5 to assemble the electrical connect assembly 100 together.

When the bolts 12 fix the heat dissipating device 4 to the printed circular board 1 and the backplane 5 together, since the post 41 of the supporting body 40 rivets with the hole 445 of the fixing portion 440 of the latching piece 44, the fixing portion 440 of the latching piece 44 always abuts against the supporting body 40 by a surface contacting, when one connecting portion 443 is pressed downwardly, a corresponding spring portion 441 will also move downwardly, but the fixing portion 440 is unmoved, so the opposite connecting potion 443 will be not rise upwardly, thus the bolts 12 can be locked into the latching pieces 44 one by one not at one time.

The fixing portion 440 of the latching piece 44 rivets with the supporting body 40 and keeps abutting against the supporting body 40, so no matter the bolts 12 firstly locks which connecting portion 443 of the latching pieces 44, the other connecting portion 443 will not rise upwardly, thus the bolts 12 can lock one by one and assure the heat dissipating dive 4 provides a balance force on the electrical package 3. Furthermore, the fixing portion 440 also can be fastened to the supporting body 40 by another mechanically connecting meatheads such as soldering.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a printed circuit board;

an electrical connector, mounted on the printed circuit board; and a heat dissipating device mounted upon the electrical connector and comprising a supporting body fixed with heat pipes and at least one latching piece pressing downwardly the supporting body, the latching piece defining a hole on each end thereof for a bolt passing through to fix the latching piece on the printed circuit board, the latching piece having fixing portion abutting against the supporting body and riveting with the supporting body.

2. The electrical connector assembly as claimed in claim 1, wherein the supporting body has a top surface with two opposite sides, a post is formed on a middle part of each of the two opposite sides.

3. The electrical connector assembly as claimed in claim 2, wherein there are two latching pieces, the fixing portion defines a hole, the post of the supporting body rivets with the hole of the fixing portion of the latching piece.

4. The electrical connector assembly as claimed in claim 3, wherein the supporting body has four supporting portions provided on a front end and a back end of each of two opposite sides thereof, respectively, and extending downwardly to set on the printed circuit board.

5. The electrical connector assembly as claimed in claim 4, further comprising a heat dissipating piece located between the electrical connector and the heat dissipating device.

6. The electrical connector assembly as claimed in claim 3, wherein the supporting body has two through slots for receiving the heat pipes.

7. The electrical connector assembly as claimed in claim 6, wherein the two latching pieces has two spring portions extending upwardly from two opposite ends of the fixing portion, the spring portion has a connecting portion bent downwardly and inwardly from a free end thereof.

8. The electrical connector assembly as claimed in claim 7, further comprising bolts, the spring portion has a first circular hole and a second circular hole on the connecting portion, the first circular hole has a diameter bigger than that of the second circular hole and is located above the second circular hole, the bolts can pass through the first and the second circular holes to mount the heat dissipating device on the printed circuit board.

9. An electrical connector assembly comprising:

an electrical connector, mounted on a printed circuit board; and a heat dissipating device mounted on the electrical connector, the heat dissipating device comprising a supporting body fixed with heat pipes and at least one latching piece located upon the supporting body, the latching piece having a fixing portion pressing downwardly the supporting body and two spring portions extending from two opposite sides of the fixing portion, the spring portion having a hole for a bolt passing through, the fixing portion directly mechanically fastened to the supporting portion to keep the fixing portion always abutting against the supporting portion.

10. The electrical connector assembly as claimed in claim 9, wherein the supporting body has a top surface with two opposite sides, a post is formed on a middle part of each of the two opposite sides.

11. The electrical connector assembly as claimed in claim 10, wherein the fixing portion defines a hole, the post of the supporting body rivets with the hole of the fixing portion of the latching piece.

12. The electrical connector assembly as claimed in claim 11, wherein the supporting body has two through slots for receiving the heat pipes.

13. The electrical connector assembly as claimed in claim 12, further comprising bolts, the spring portion has a first circular hole and a second circular hole on the connecting portion, the first circular hole has a diameter bigger than that of the second circular hole and is located above the second circular hole, the bolts can pass through the first and the second circular holes to mount the heat dissipating device on the printed circuit board.

14. An electrical connector assembly comprising:

a printed circuit board;

an electrical connector mounting upon the printed circuit board;

an electronic package mounted upon the connector with electrical connection therebetween;

a heat dissipation device mounted upon the connector and including a support member located above the electronic package, a latching piece respectively retaining to the printed circuit board and the support member in a tensional manner, and a heat pipe assembled to the support member and absorbing heat from the electronic package for heat transfer.

15. The electrical connector assembly as claimed in claim 14, further including a heat dissipation plate sandwiched between the heat pipe and the electronic package.

16. The electrical connector assembly as claimed in claim 15, wherein the support member is configured to restrain said heat dissipation plate in at least one direction.

17. The electrical connector assembly as claimed in claim 15, wherein said latching device is configured to restrain said heat dissipation plate in at least one direction.

18. The electrical connector assembly as claimed in claim 14, wherein said latching device defines a U-shaped structure at one end where retention between the latching device and the printed circuit board occurs.

19. The electrical connector assembly as claimed in claim 18, wherein said U-shaped structure defines a lower arm through which a bolt extends, and an upper arm being opposite to said lower arm and equipped with a through hole for allowing a screw drive to extend therethrough during fastening of said bolt.

* * * * *